United States Patent [19]

Londagin

[11] Patent Number: 4,592,464

[45] Date of Patent: Jun. 3, 1986

[54] FOLDING DISPLAY MERCHANDISE BOX

[76] Inventor: David G. Londagin, 1431½ Verd Oaks Dr., Glendale, Calif. 91205

[21] Appl. No.: 620,875

[22] Filed: Jun. 15, 1984

[51] Int. Cl.[4] ..... B65D 79/00

[52] U.S. Cl. ..... 206/45.28; 206/45.13; 206/45.29

[58] Field of Search ..... 206/44 R, 45.13, 45.28, 206/45.29, 45.19

[56] References Cited

U.S. PATENT DOCUMENTS

| | | | |
|---|---|---|---|
| 1,434,165 | 10/1922 | Ter Eyck | 206/45.29 |
| 1,903,461 | 4/1933 | Keller | 206/45.29 |
| 2,148,533 | 2/1939 | Chapman | 206/45.29 |
| 2,647,621 | 8/1953 | Bowden | 206/45.29 |
| 3,159,273 | 12/1964 | Schecterson et al. | 206/45.19 |

FOREIGN PATENT DOCUMENTS

| | | | |
|---|---|---|---|
| 476873 | 12/1937 | United Kingdom | 206/45.29 |

*Primary Examiner*—William T. Dixson, Jr.
*Assistant Examiner*—Brenda J. Ehrhardt
*Attorney, Agent, or Firm*—Christie, Parker & Hale

[57] ABSTRACT

An improved display box of the type having a bottom, upstanding front and rear panels and sides cooperating to define an upwardly open container to receive and hold a selected commodity, such as candy, pastries, electronic parts, cosmetics or the like. A top is connected to the rear wall by a hinge such that the top may be pivoted to a closed position closing the container, or to an upright position exposing the contents of the container. To provide for display, the top includes a support panel extending a first distance from the hinge to a first score line. A display panel extends a second, greater distance from the first score line to a second score line. Completing the top is a lock flap which extends from the second score line to a leading edge. When the container is closed, the flap folds into the compartment. When it is desired to display the container contents, the top is folded 180° about the first score line such that the display panel overlies the support panel and both such panels are in an upright position defining a display mast. In this position, the flap leading edge lies adjacent the bottom to resist forward pivoting of the mast. Additionally, the second score line is displaced relative to the underlying hinge such that the second score line and hinge are unable to cooperate to define a common pivot. The container further includes means for holding the mast rigidly in the upright position.

5 Claims, 9 Drawing Figures

Fig. 5A
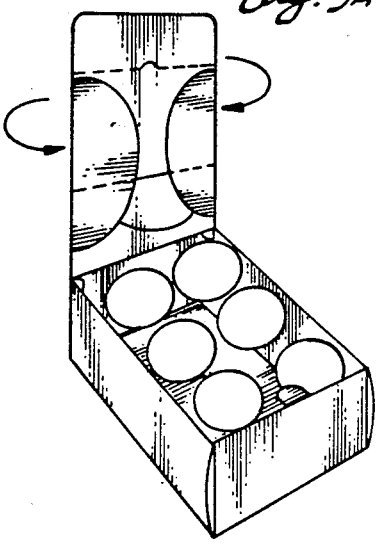
Fig. 5B
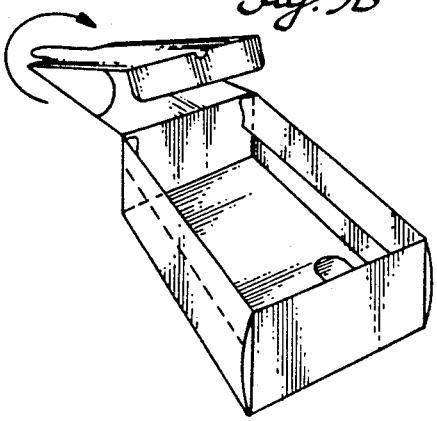
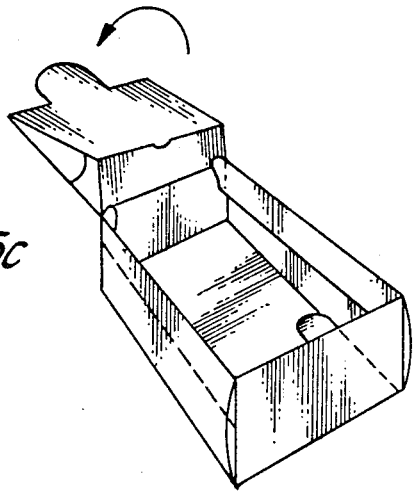
Fig. 5C
Fig. 6.
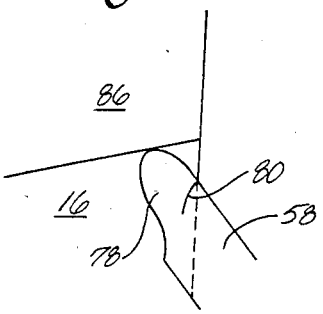

FOLDING DISPLAY MERCHANDISE BOX

FIELD OF THE INVENTION

This invention relates to containers such as boxes. More particularly it relates to display type boxes adapted to not only provide a container for goods but also to provide a display therefor.

BACKGROUND OF THE INVENTION

Containers fashioned from cardboard, boxboard and the like are well known in the art. In order to retain a commodity such as candy, pastry or the like, these boxes have a bottom, upstanding front and rear walls and sides, which collectively define an upwardly open container for the commodity. A top is commonly provided to close the container to protect the commodity during shipping, handling and storage.

To reduce the cost of manufacturing these boxes, it is well known to cut or stamp a box blank from a flat sheet of, for example, boxboard. The die used to stamp the blank also scores the blank along selected lines, curves, etc. to enable a person to easily fold the various portions of the blank along such scores into the three-dimensional container including a hinged top. Typical cake and pie boxes are of this nature.

For advertising purposes, it has been known to score the top of the box so that it can be folded to create an upstanding mast while at the same time revealing the contents of the container. Advertising logos, slogans, trademarks or the like can be imprinted on the top such that, when the top is in the mast position, such material is prominently displayed.

A problem with the foregoing mast display-type containers is that the resulting mast is not strong more specifically because of the designs now commonly used and therefore is easily toppled from the desired upstanding display position, concealing the advertising material while at the same time perhaps covering the goods in an awkward and unappealing manner. Heretofore, it is believed that those skilled in the art have not found an easy, inexpensive means by which the mast can be strengthened.

SUMMARY OF THE INVENTION

There is, therefore, provided in the practice of the present invention an improved display box of the type having a bottom, upstanding front and rear panels and sides, cooperating to define an upwardly open container to receive and hold a selected commodity, such as candy, pastries or the like, but by no means limited to such commodities. A top is connected to the rear wall by a hinge such that the top may be pivoted to a closed position closing the container or to an upright position exposing the contents of the container.

To provide for display, the top includes a support panel extending a first distance from the hinge to a first score line. A display panel extends a second, greater distance from the first score line to a second score line. Completing the top is a lock flap which extends from the second score line to a leading edge. When the container is closed, the flap is folded along the second score to lie adjacent the front wall to enable the top to be affixed thereto as, for example, by tape or a tab lock. The combined length of the support and display panels is comparable to the bottom for closure of the container. Additionally, the combined length of the rear wall and support panel is substantially the same as the length of the display panel and flap.

When it is desired to display the container contents, the top is folded 180° about the first score line such that the display panel overlies the support panel and both such panels are in an upright position defining a display mast. In this position, the flap leading edge lies adjacent the bottom to resist forward pivoting of the mast. Additionally, the second score line is displaced relative (i.e., does not overlap) to the underlying hinge. It is stated in the graphics terminology that they are out of register with each other. Accordingly, the second score line and hinge are unable to cooperate to define a common pivot about which the mast could otherwise easily pivot. This avoids the very problem that most commonly available designs heretofore have exhibited, i.e., floppy display masts. Therefore, when the mast is in the display mode, the mast projects upward in a stable manner to reveal the contents of the container and provide a reliable display therefor.

The container further includes means for holding the mast in the upright position by force. These means keep the mast from billowing forward or backward while remaining in an upright position as differentiaded from pivoting. Uniquely, for this purpose the container includes at its sides, pressure fingers adapted to trap the flap firmly against the rear wall.

To protect the contents, the container may also have drape flaps integrally formed as part of the top. When the container is closed, these flaps are folded so as to project from the top to inside the container adjacent its sides. Accordingly, the drape flaps prevent the contents from escaping between the top and sides similarly preventing foreign objects from entering the container. Alternately, the drape flaps can be fashioned to drape outside the box and the closure accomplished with cherry locks or tuck locks, in certain applications where this may be desirable. The operation of the display mast would remain fully workable, unaffected by the change.

When the top is in the mast position, the drape flaps fold in flat and become trapped between the support and display panels. Portions of each drape flap reside between the first and second score lines for strengthening the mast and preventing pivoting about either of said score lines.

BRIEF DESCRIPTION OF THE DRAWINGS

These and other features and advantages of the present invention will become apparent as the same becomes better understood with reference to the following specification and drawings, wherein:

FIG. 3 is a plan view of a box blank cut from boxboard or the like to be folded to define the box without the necessity of using glue, tape, staples or the like;

FIGS. 5A through 5C show the folding of the box top to create the display mode; and FIG. 6 is an enlarged portion of the box showing means for holding the box in the display mode.

DETAILED DESCRIPTION

Figure 1:
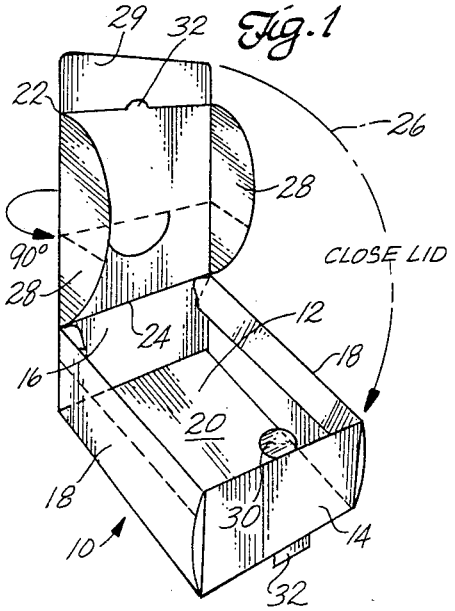
FIG. 1 is a front perspective view of the box according to the present invention showing closure thereof.
Figure 2:
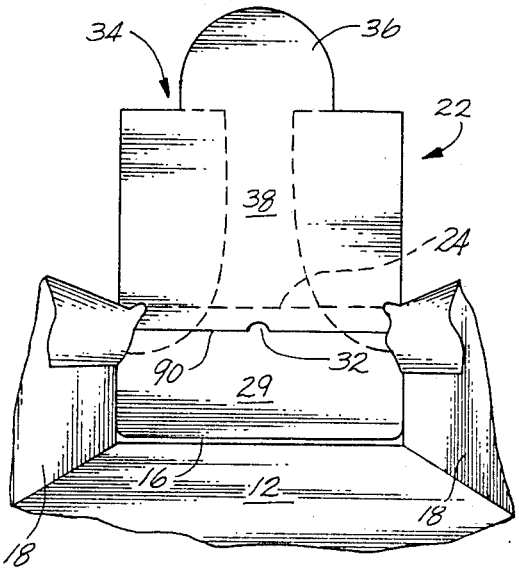
FIG. 2 is a front perspective view of a portion of the box showing it in the display mode.

Turning to the drawings, FIG. 1 shows a display box 10 according to the present invention. The box 10 is adapted to function in one of two modes. In a "box" mode as shown in FIG. 1, the box 10 is adapted to hold a commodity such as candy, pastries, or other relatively light items, such as certain electronics for storage, shipping and handling. Accordingly, in the box mode, the box 10 functions like any other box. In a "display" mode, as illustrated in FIG. 2, the box not only continues to retain the commodity as originally packed but also advantageously provides an upright display of advertising/promotional logos, slogans, trademarks or the like to induce consumers to purchase the commodity. In that the box 10 is adapted to function in both the box and display modes, separate advertising flyers, posters and the like are not needed since the box itself performs this function most economically.

The box 10 is constructed to have a bottom 12 to provide an underlying support of the contained commodity. Upstanding from the bottom 12 are front and real walls 14 and 16, respectively, and sides 18. The bottom 12, front and rear walls 14 and 16 and sides 18 are interconnected to define an upwardly open compartment 20 to hold a selected commodity such as candy, pastries, pie, cake, buttons, hardware, computer softwear, cosmetics or whatever. For purposes of the following description, the commodity will be referred to as candy, however it is to be understood that any selected article or articles could be placed in the compartment 20 of the box 10.

To close the compartment 20 and protect the candy therein, the box 10 includes a top 22. The top 22 is connected to the rear wall 16 by a hinge 24 which, as described below, may be simply a score line about which the top 22 can fold. As shown in FIG. 1, by virtue of the hinge 24, the top 22 can fold relative to the rear wall 16 as shown by arrow 26 to a closed position wherein the top 22 covers the compartment 20. In the closed position the top 22 is arranged substantially parallel to the bottom 12 and lies adjacent to the upper extent of the sides 18 and forward wall 14.

To prevent the candy from escaping between the sides 18 and the top 22 and at the same time preventing foreign material from entering the compartment to comingle with the candy, the top 22 includes drape flaps 28 which may be folded to lie orthogonal to the top 22. When the top 22 is in the closed position, the drape flaps 28 extend into the compartment 22 or just outside the sides 18 lie adjacent the sides 18, preventing the candy from escaping the compartment or foreign materials from entering.

As is often the case, it is neccessary to provide a means whereby the top 22 can be locked in the closed position to provide for the shipping and handling of the commodity.

To cooperate with the drape flaps 28, the top 22 includes a lock flap 29 capable of being folded relative to the top 22 to lie, when the top 22 is in the closed position, within the compartment 20 adjacent the front wall 14. Like the drape flaps 28, the lock flap 29 prevents the contents of the box 10 from falling out from beneath the top 22 and likewise prevents foreign materials from entering the compartment 20. To lock the top 22 in a closed position for storage, shipping and handling, any suitable means such as tape or the like may be used. As shown in FIG. 1, a preferable method is to provide a lock tab 30 on the front wall 14 and a lock slit 32 on the top 22. In the closed position the lock tab 30 is inserted through the lock slit 32 holding the top 22 in the closed position. Lock slit 32 has a curved configuration that renders it easy to grasp with thumb and fingers for opening or closing the box in conjunction with lock tab 30. It is advantageous that the lock flap 29 be positively anchored as it does not bottom. Accordingly, lock flap 29 could be configured to lock outside or be taped outside, with some sacrifice of the graphics on the outside of forward wall 14. Generally, for semi-supporting and full-supporting loads, it is best as shown here in FIG. 1.

At the point of sale it is advantageous that the seller have a simple, inexpensive means by which the contents of the box 10 may be promoted or advertised. For this purpose, the box 10 can be configured to appear in the display mode as shown in FIG. 2. In the display mode, the box 10 reveals its contents (i.e., the top is open) and at the same time displays promotional/advertising materials such as artwork, trick cut-outs, logos, slogans, trademarks and the like which are associated with the contents.

To manipulate the box 10 into the display mode, the top 22 is opened by disengaging the lock tab 30 from the lock slit 32 and pivoting the top 22 about the hinge 24 revealing the contents residing in the compartment 20. Thereafter, the top is folded upon itself in a manner described below to define a display mast 34 as shown in FIG. 2. It should be noted that while the mast 34 is shown as including a semi-circular display header 36, the upstanding mast 34 can have any suitable shape such as silhouettes of sailboats, animals, girls or whatever. Additionally, in the display mode a portion of the top 22 defines a display panel 38 which, along with the header 36, may be imprinted with promotional/advertising material, including theme colors or art running all the way to the bottom of the box.

In the display mode, several constraints should be noted. One is that the construction necessary to enable the top 22 to assume the display mode should not significantly impact the overall cost of the box 10. Further, means should be provided for maintaining the mast 34 in the upright position, even should the mast 34 be bumped or otherwise displaced as by other boxes leaning thereagainst. Again, these means for supporting the mast 34 should not significantly impact the overall cost of the box 10.

Figure 4A:
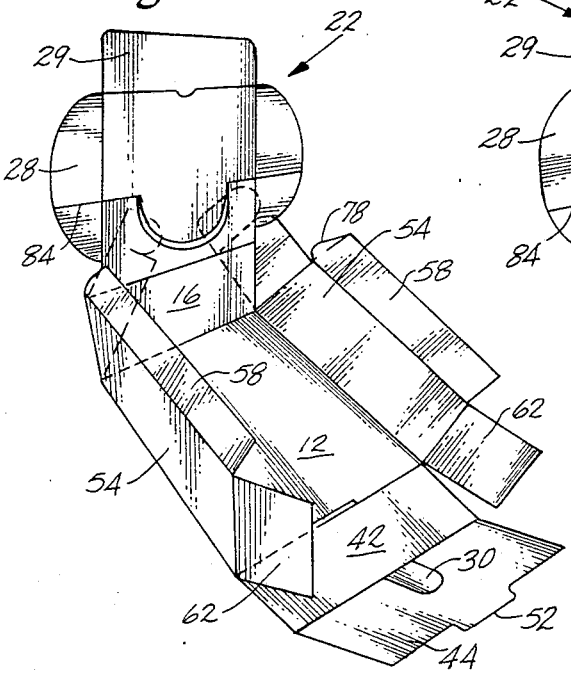
FIGS. 4A and 4B show the folding of the box blank to define a three-dimensional box of FIG. 1.
Figure 4B:
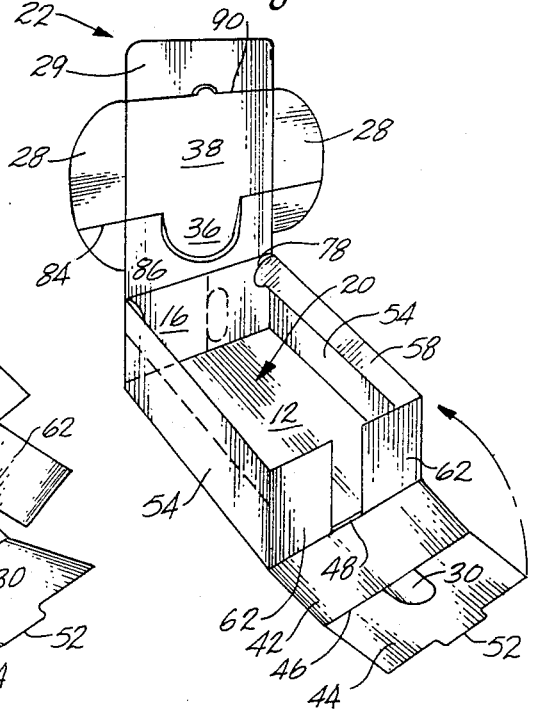
Figure 3:
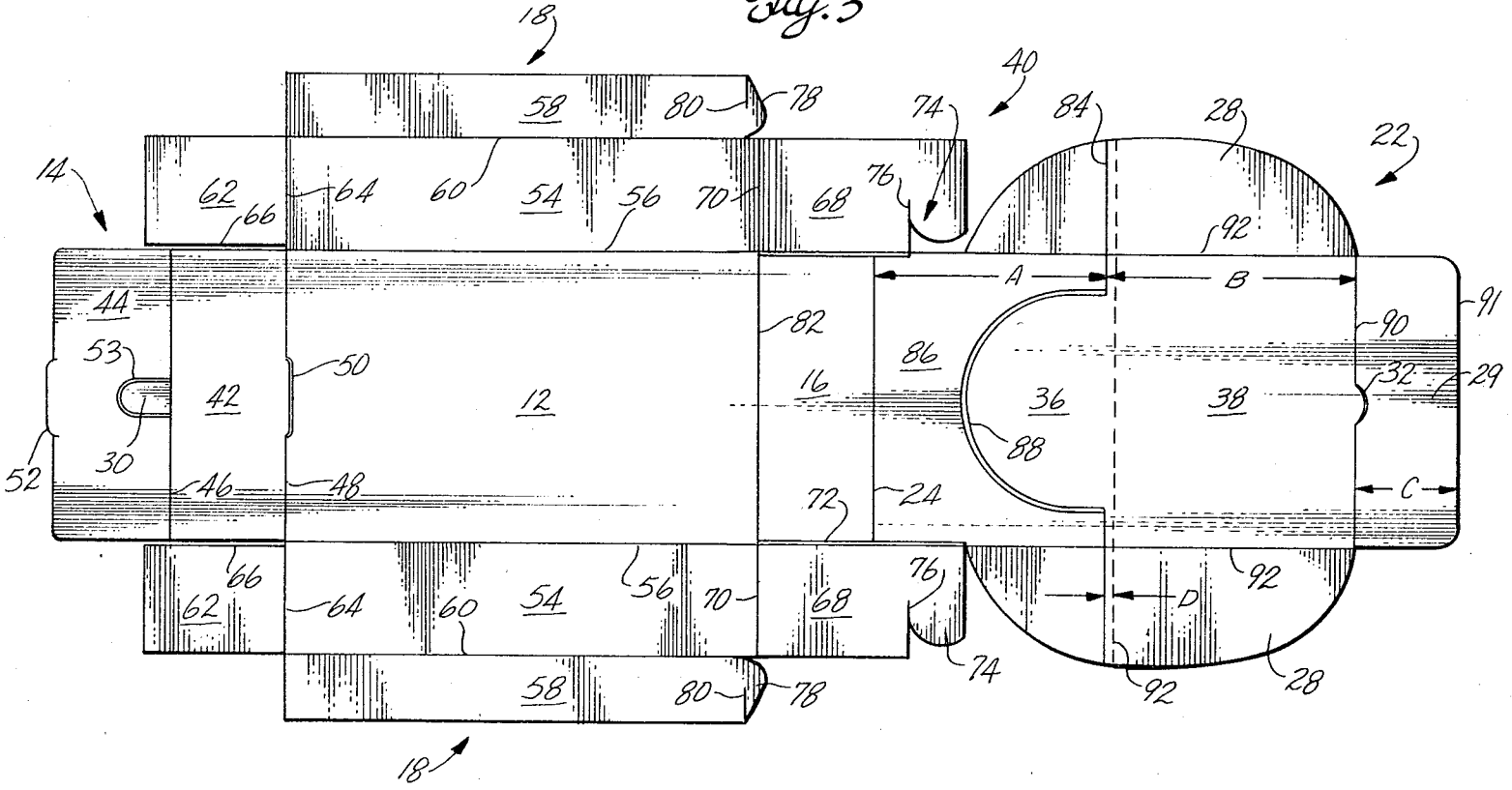

To enhance the inexpensive production of the box, the preferable manufacturing technique is to stamp a box blank 40 from a flat sheet of boxboard, cardboard, or the like as shown in FIG. 3. Because of its economical composure in size this configuration can often be stamped in groups of three or four. Referring to FIGS. 4A and 4B, in conjunction with FIG. 3, the blank 40 and the manner of folding to create the box 10 will be described.

The blank 40 is stamped from a flat sheet of boxboard, the die used for stamping also being adapted to score the blank 40 at various locations for ease of folding. In folding the various portions of the blank 40 as hereinafter described, the scores define fold lines which promote and guide the various portions of the blank 40 during folding thereof. In FIG. 3 the score lines are represented by single lines whereas cuts and slits are represented by double lines.

In FIG. 3 the bottom 12, front wall 14, rear wall 16, sides 18 and top 22 of the blank 40 are shown. The front wall 14 includes inner and outer panels 42 and 44 joined at a score 46, the inner panel 42 in turn joined to the bottom 12 by a score 48. Along the score 48, a tab slit 50 is created to receive a tab 52 located along the remote edge of the outer panel 44. The lock tab 30 is seen as being located on the outer panel 44 adjacent the score 46 and as being defined by an arcuate slit 53.

To define each of the sides 18, the blank 40 includes a side panel 54 joined to the bottom by a longitudinally extending score 56. Opposite the bottom 12 each side 18 includes a roll-over side flap 58 joined to the side panel 54 by a score 60. To provide a means to structurally interlock the upstanding portions of the box 10, each side 18 includes an interlock flap 62 joined to the side panel 54 by a score 64 and severed from the front wall 14 by a cut 66. The interlock flap 62 extends from the side panel 54 a distance approximately equal to that of one-half the length of the score 48 which represents the joinder between the inner panel 42 and the bottom 12. To provide a positive anchor for each roll over side flap 58, an anchor flap 59 is provided spaced from the interlock flap 62 by a cut 67.

Opposite the interlock flap 62 each side 18 includes a cracker lock 68 joined to the side panel 54 by a score 70. Each cracker lock 68 is severed from the rear wall 16 and top 22 by a cut 72. Cracker lock 68 includes a finger 74 and an adjacent cracker lock slit 76, the purpose of which will hereinafter become evident.

To provide a means to maintain the mast 34 (FIG. 2) in an upright position, each side 18 includes on the side flap 58 a pressure finger 78 joined to the side flap 58 by a torsion score 80. The torsion score, unlike an ordinary score which aims at affording a bend in the material affords a predetermined twist to pressure finger 78. Without the torsion score 80, pressure finger 78, when rolled over into the erected position (see FIG. 4B) against rear wall 16 will distribute moments of force at random in side flap 58. In most cases the lack of torsion score 80 will cause crinkling, following to some extent the grain or weaker spots in the material of side flap 58 and in most cases defeating the purpose thereof. As shown in FIG. 3, each pressure finger 78 is somewhat eliptical in shape and extends to project past (i.e., to the right in FIG. 3) the score 70. Pressure finger 78 must protrude out just the proper amount beyond score 70 to allow it to form in imaginary triangle conjunction with torsion score 80. The inherent properties of the material of which side flap 58 is composed, together with the calipre in thickness of material box 10, wetness, drying and brittleness or ability to bend or withstand bending will determine the actual distance pressure finger 78 is to subtend to the right of score 70 in order to attain triangle 81 shown in FIG. 6.

The rear wall 16 is joined to the bottom 12 by a score 82, the rear wall being severed by the cuts 72 from the cracker locks 68. Opposite the score 82, the rear wall 16 terminates at the hinge 24 which, in the box blank 40, appears as a score. From the hinge 24, the top 22 projects outward (to the right in FIG. 3) from the rear wall 16 a first distance A to a mast score 84. That portion of the top 22 defined by the distance between the hinge 24 and the mast score 84 defines a support panel 86. To define the header 36, a circular slit 88 projects into the support panel 86 from the mast score 84. The mast score 84 from the slit 88 extends laterally (i.e., vertically upwardly and downwardly in FIG. 3) across the remainder of the support panel 86 and the drape flaps 28. It is to be understood, however, that the top 22 could be fashioned without the header 36 by simply not providing the slit 88 and extending the mast score 84 continuously across the top 22, and likewise slit 88 could take any shape outlining the shape of a girl, fleecy clouds or whatever.

From the mast score 84 the display panel 38 extends a second greater distance B to a lock flap score 90 which defines the joinder between the display panel 38 and the lock flap 29. The lock slit 32 is cut at a location along the lock flap score 90. Lock slit 32 may be curved as shown in FIG. 3 to accomodate a thumb. As shown and for purposes which will become evident, lock flap 29 extends a distance C to terminate at leading edge 91. The drape flaps 28 are connected to the support and display panels 86 and 38 by scores 92.

To construct the box 10 from the blank 40, each of the sides 18 is folded upwardly from the bottom 12 along scores 56, as shown in FIG. 4A. Additionally, the rear wall 16 is folded to an upright position. At the outside of the rear wall (opposite the compartment 20) the cracker locks 68 are folded along scores 70 and the fingers 74 are interlocked in a fashion which is well known in the art. The side flaps 58 are folded downwardly along the scores 60, such action causing 1) anchor flaps 59 to face and abut side flaps 62, and 2) the pressure fingers 78 to bear against the rear wall 60 and somewhat deflect, forming the triangle with rear wall 16 and to a lesser degree with bottom edge of support panel 86 as before described. Thereafter, the interlock flaps 62 are folded inwardly along the scores 64 together with anchor flaps 59 that have automatically fallen into place as described above, such that they substantially overlie the score 48 as shown in FIG. 4B. Finally, the inner panel 42 is folded along the score 48 to an upright position adjacent the interlock flaps 62 and the outer panel 44 is folded along the score 46 in a direction into the compartment 20, trapping the interlock flaps 62 and anchor flaps 59 between the aforesaid inner and outer panels 42 and 44. Inserting the tab 52 through the tab slit 50 locks the forward wall 14 in an upright position, traps the interlock flaps 62 together with anchor flaps 59, and, in cooperation with the cracker lock 68, holds the components of the box 10 in a rigid manner so as to define the compartment 20, as shown in FIG. 1.

To close the box 10 the top 22 is folded about the hinge 24 as shown by arrow 26 (FIG. 1) to the closed position. For adequate closure of the compartment 20, it should be noted that the combined longitudinal lengths of the display and support panels 38 and 86, as represented by distances A and B of FIG. 3, are substantially the same as the longitudinal dimension of the bottom 12.

When it is desired to place the box 10 in the display mode to vend its contents, the top is folded as shown in FIGS. 5A through 5C. Opening the top 22 to an upright position as shown in FIG. 5A, the drape flaps 28 are folded inward along scores 92 to lie flat against the display and support panels 38 and 86. Thereafter, the top 22 and drape flaps 28 are folded along score 84 approximately 180° as shown in FIG. 5B, this folding causing the lock flap 29 to be located adjacent the rear wall 16. At this point, an important feature of the box 10 should be noted.

Referring to FIG. 3 and as stated above, the distances A and B defining the support and display flaps differ. Imaginary line 94 represents the bisection of the combined lengths of the display and the support panels 38 and 86. Heretofore, the common practice has been to score tops along the line 94 in order to create the mast 34. However, it has been found that offsetting the score 84 from the line 94, a distance D as represented in FIG.

3, unexpectedly results in the strengthening of the mast 34. Distance D cannot be selected at random but must be a discrete selection based on the formula later stated herein. Only a discrete selection of distance D will allow for both strengthening of mast 34 and particularly the entry of leading edge 91 of lock flap 29 behind pressure fingers 78. Given any length, width and depth of box 10, by mechanical trial-and-error or the additional application of calculus and geometry, a discrete distance D can be arrived at. As can be appreciated by virtue of the slit 88, the folding of the top 22 about the mast score 84 causes the header 36 to extend outwardly therefrom causing increased height to the display mast 34. Continuing with FIG. 5C, it is seen that the final step in creating the mast 34 is to insert the lock flap 29 between the rear wall 16 and the pressure finger 78 sliding the lock flap 22 downwardly until its leading edge abuts the bottom 12 as shown in FIG. 2. In order for the mast 34 to stand upright, the offset of the mast score 84, as represented by D, must be compensated for by shortening the longitudinal length of the lock flap 29. In that the top 22 is doubled upon itself by the fold along the mast score 84, a change in the offset distance D must necessarily result in a change in the length C if the mast 34 is to stand upright. An equation for this change, which has been found useful in designing the box 10 is:

$$2\,\Delta D = \Delta C,$$

where the Δ represents change.

As shown in FIG. 2, the offset of the mast score 84, i.e., the differing lengths A and B, results when the box 10 is in the display position in the lock flap score 90 being positioned below the hinge 24. Unlike the condition if the mast score line were positioned along the line 94, the lock flap score 90 and hinge 24 are unable to cooperate to define a common pivot about which the mast 34 would otherwise freely rotate. Great shear strength is retained in mast 34 just as if no scores were present at 90 and hinge 24. Furthermore, the drape flaps 28 project cooperatively past both the hinge 24 and lock flap score 90 for strengthening the mast 34 in the upright position.

Over and above the arrangement of the lock flap score 90 and the hinge 24 to prevent the formation of a common pivot, the box 10 includes means for holding the mast 34 in the upright position. These means are embodied as the pressure fingers 78 which press against the top 22 at the lock flap score 90 further strengthening and holding the upright stance of the mast 34. Along with the pressure finger 78, the leading edge 91 lies adjacent the bottom 12 further strenthening the upright stance of the mast 34.

As can be appreciated from the foregoing, the box 10 can be inexpensively manufactured to have, when it is in the display mode, a sturdy upright display mast 34 revealing and promoting the sale of the contents of the box 10. The offsetting of the mast score 84, the inclusion of the pressure fingers 78 and the shortening of the lock flap 29 so that it bears against the bottom 12 when the mast 34 is in the upright position, provide a very sturdy mast 34 which is not subject to falling even should it be inadvertently bumped or otherwise displaced. In fact, some discrete selections of dimension D render a box 10 with a display mast 34 so steady it can be punched back and forth repeatedly like a punching bag and the mast 34 will return to its original rigid upright position. This feature assures that the promotional material imprinted upon the display 38 is presented to the customers' view in any imaginable retail store environment, from the time compartment 20 is first exposed to public view full of merchandise and even after it is completely empty. Unlike the common configurations currently utilized, box 10 with display 38 does not depend on merchandise to help keep mast 34 erect. It is the arrangement of scores, panels and pressure fingers to attain a rigid display mast 34 rapidly with a minimum of box material that is the main goal, not merely the shape of the box 10.

While I have disclosed certain embodiments of the present invention, it is subject to many modifications without departing from the spirit and scope of the attached claims.

What is claimed is:

1. A display container of the type having a bottom, upstanding front and rear walls and sides defining an upwardly open compartment and a top connected to the rear wall along a hinge to close the container compartment, the improvement comprising:

a top including a support panel having a first length extending from the hinge to a first score, a display panel having a second length greater than the first length and extending from the first score to a second score and a lock flap extending from the second score and terminating at a leading edge, said flap foldable about said second score to lie adjacent the front wall when the container is closed, said top being foldable about the first score to an upstanding mast position wherein the front and rear panels are superposed and the flap lies adjacent the rear wall, in said mast position the leading edge lying contiguous the bottom whereupon the second score is offset with respect to the hinge to strengthen the upstanding position of the mast; and means for holding the top the top in said mast position.

2. The container of claim 1 wherein the holding means include pressure fingers disposed at the container sides to press at least the lock flap against the rear wall.

3. The container of claim 2 wherein the pressure fingers press against the top at the second score to hold the lock flap and a portion of the display panel against the rear wall and prevent the top from folding about the second score.

4. The contained of claim 2 wherein the top includes a pair of drape flaps adapted to extend between the top and sides when the container is closed, said drape flaps foldable to become trapped between the support and display panels when the top is in the mast position and project across the hinge to resist pivoting by the mast about said hinge and to serve as tightening wedges against the pressure fingers.

5. The container of claim 2 wherein each box side includes a side flap foldable relative to an upstanding side panel to lie within the compartment, the side flap including said pressure finger and a torsion score about which the pressure finger can flex to press at least the lock flap against the rear wall.

* * * * *